US010711742B2

(12) United States Patent
Mahmood

(10) Patent No.: US 10,711,742 B2
(45) **Date of Patent: *Jul. 14, 2020**

(54) VEHICLE AIR INTAKE HOUSING

(71) Applicant: Element 1 Engineering Ltd., Bedfordshire (GB)

(72) Inventor: Bilal Mahmood, Bedfordshire (GB)

(73) Assignee: Element 1 Engineering Ltd., Bedfordshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/195,044

(22) Filed: Nov. 19, 2018

(65) Prior Publication Data

US 2019/0085798 A1 Mar. 21, 2019

Related U.S. Application Data

(63) Continuation of application No. 14/631,431, filed on Feb. 25, 2015, now Pat. No. 10,132,277.

(51) Int. Cl.
*F02M 35/02* (2006.01)
*F02M 35/024* (2006.01)

(52) U.S. Cl.
CPC ... *F02M 35/02416* (2013.01); *F02M 35/0202* (2013.01); *F02M 35/02483* (2013.01)

(58) Field of Classification Search
CPC ..... B01D 46/0043; B01D 46/0021; B01D 46/0012; B01D 46/0002; B01D 46/2403; B01D 46/0001; B01D 46/0024; B01D 29/906; F02M 35/02416; F02M 35/0202; F02M 35/02483; F02M 35/02; F02M 35/024
USPC ..... 55/385.3, 327, 331, 482, 336, 498, 521, 55/529, 391; 123/198 E
See application file for complete search history.

(56) References Cited

U.S. PATENT DOCUMENTS

| | | | | |
|---|---|---|---|---|
| 5,106,397 | A | 4/1992 | Jaroszczyk | |
| 5,522,909 | A | 6/1996 | Haggard | |
| 5,549,724 | A | 8/1996 | Mochida | |
| 5,888,260 | A | 3/1999 | Sica | |
| 5,972,059 | A | 10/1999 | Morgan | |
| 6,319,298 | B1 | 11/2001 | Ng-Gee-Quan | |
| 6,833,023 | B1 | 12/2004 | Vandenberghe | |
| 6,916,353 | B2 | 7/2005 | Tang | |
| 7,452,395 | B2 | 11/2008 | Fiello | |
| 8,029,586 | B2 | 10/2011 | Linhart | |
| 8,663,355 | B2 | 3/2014 | Nelson | |
| 10,132,277 | B2 * | 11/2018 | Mahmood | F02M 35/02416 |
| 2003/0089233 | A1 | 5/2003 | Borla | |

(Continued)

*Primary Examiner* — Minh Chau T Pham
(74) *Attorney, Agent, or Firm* — Hunton Andrews Kurth LLP

(57) ABSTRACT

A vehicle air intake assembly is disclosed. The assembly includes a housing, a conical filter, and optionally may also include an inlet cowl. The housing and filter decrease in diameter from an inlet or distal end toward a proximal or outlet end. The shape of the housing guides the air into a smaller cross-sectional area and induces a Venturi effect on the airflow passing through the housing and filter. The housing decouples the filter from an engine inlet and the proximal or outlet end of the housing is sized so as to attach to the engine inlet and provide a smooth transition for the air leaving the housing and entering the engine inlet.

10 Claims, 6 Drawing Sheets

(56) References Cited

U.S. PATENT DOCUMENTS

| | | | | |
|---|---|---|---|---|
| 2004/0134171 | A1 | 7/2004 | Scott | |
| 2006/0288673 | A1 * | 12/2006 | Wimmer | F02M 35/02483 55/385.3 |

* cited by examiner

VEHICLE AIR INTAKE HOUSING

CROSS REFERENCE TO RELATED APPLICATION

The subject application is a Continuation Application of U.S. application Ser. No. 14/631,431, filed Feb. 25, 2015, now U.S. Pat. No. 10,132,277, which is hereby incorporated by reference herein in its entirety.

FIELD OF THE INVENTION

The field of the present invention relates generally to an air intake housing for vehicles.

BACKGROUND

Motor vehicles are equipped with an air filter system that filters air destined for the engine. Conventional air filter systems use a cuboidal filter enclosed by a cuboidal housing. This type of air filter cause the air to transition from a rectangular filter housing outlet to a cylindrical pipe inlet. Such an abrupt transition in geometrical shape causes the airflow to be turbulent, and hence causes engine "choking," particularly at high RPM.

More recent, aftermarket intake systems use a conical filter in place of the conventional rectangular filter. The conical filter in these aftermarket systems is directly connected to the inlet pipe of the engine and is oriented such that the smaller diameter of the conical filter is upstream and the larger diameter is downstream with respect to airflow into the engine. Moreover, the larger diameter of the conical filters conventionally has a neck attached to the filter to allow the filter to be connected to piping, such as engine air inlet piping.

The conventional air intake systems, whether cuboidal or conical, do not properly shape the airflow directed into the engine or carburetor inlet. For example, in conical filters positioned with their larger diameter adjacent the engine inlet, airflow must negotiate through an abrupt change in geometrical shape from the filter material through the smaller diameter neck that leads to the engine inlet. This causes turbulent airflow in the filter and inhibits the airflow from increasing in velocity as the air traverses the filter and enters the engine inlet. These and other deficiencies exist.

DETAILED DESCRIPTION OF THE INVENTION

Reference will be made in detail to exemplary embodiments, examples of which are illustrated in the accompanying drawings. It should be appreciated that the same reference numbers will be used throughout the drawings to refer to the same or like parts. The following description is intended to convey a thorough understanding of the embodiments described by providing a number of specific embodiments. It should be appreciated that the following detailed descriptions are exemplary and explanatory only and are not restrictive. As used herein, any term in the singular may be interpreted to be in the plural, and alternatively, any term in the plural may be interpreted to be in the singular.

Exemplary embodiments of the present invention pertain to a filter housing that encloses a conical filter. The conical filter is reversed so that the larger diameter is upstream with respect to the smaller diameter and the engine inlet. The filter housing decouples the filter from the engine inlet such that the filter, or a neck attached to the filter, is not mounted directly onto the inlet tubing of the engine. In exemplary embodiments, the larger diameter ends of the conical filter and housing are open to the surrounding environment such that air enters the housing and conical filter from the surrounding environment at the larger diameter side and is gradually led to the smaller diameter side of the conical filter and housing. Like the filter, the housing that encapsulates the filter gradually reduces in diameter from a larger diameter to a smaller diameter. In exemplary embodiments, the small-diameter side dimensionally matches the inlet tubing diameter of the engine inlet so as to enable attachment between the housing and engine inlet. The funnel-shaped housing invokes the Venturi effect where the smooth reduction in cross-sectional area along the length of the housing causes the airflow to increase in velocity as the air passes through the housing. Moreover, the housing shields the filter and airflow from heat emanating from the engine bay, thereby enabling cool, atmospheric air to enter the engine.

Figure 1:
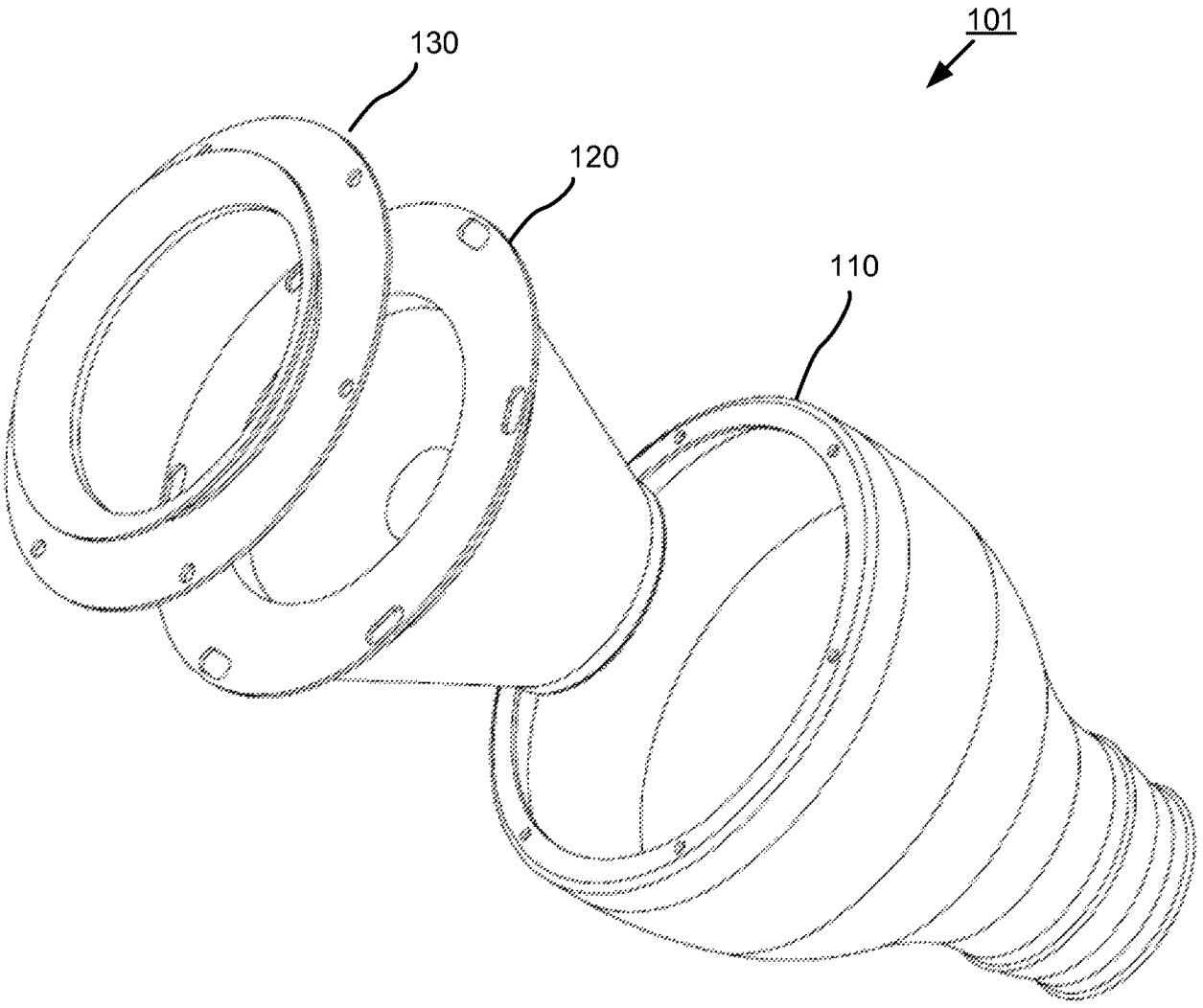
FIG. 1 depicts a perspective view of an exemplary air intake housing assembly according to an exemplary embodiment.

Referring to FIG. 1, an exploded view of an exemplary Venturi air intake housing assembly is shown. The exemplary housing assembly comprises a housing 110, a conical filter 120, and optionally may further comprise an inlet cowl 130. The housing 110 is shaped such that there is a smooth reduction in cross-sectional area along the substantially entire length of housing 110.

Figure 2:
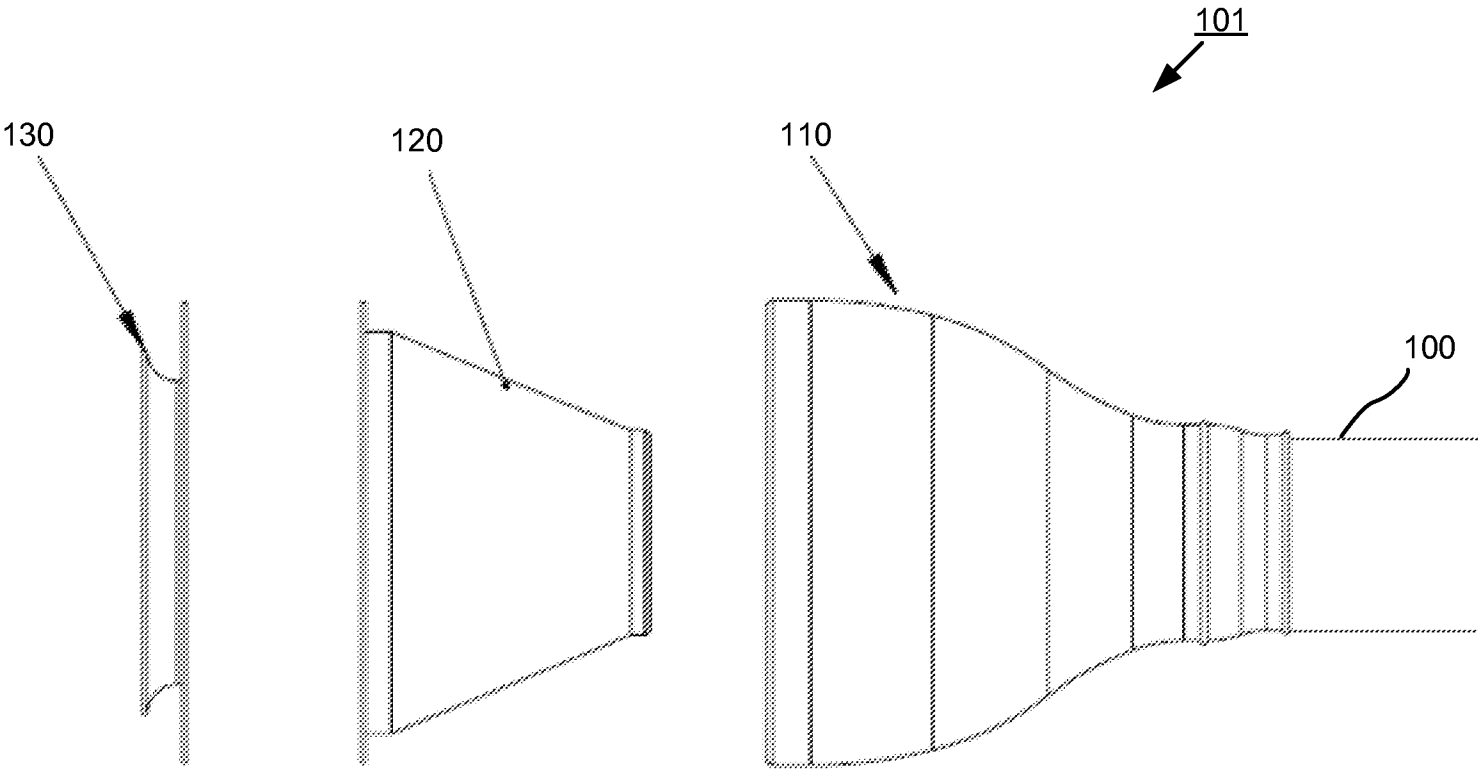
FIG. 2 depicts a side view of the exemplary air intake housing assembly of FIG. 1, according to an exemplary embodiment.

Referring to FIG. 2, an exploded side view of the exemplary Venturi air intake housing assembly 101 of FIG. 1 is shown. Housing 110 may be connected directly to engine inlet 100 with bolts and/or ring clamps, for example. The engine inlet 100 may refer to the inlet tubing of the engine through which filtered, ambient air passes, or may refer to an airflow sensor tube. The Venturi air intake housing assembly 101 may be retrofitted onto the engine inlet 100 so as to replace a conventional cuboidal air intake system.

Figure 3:
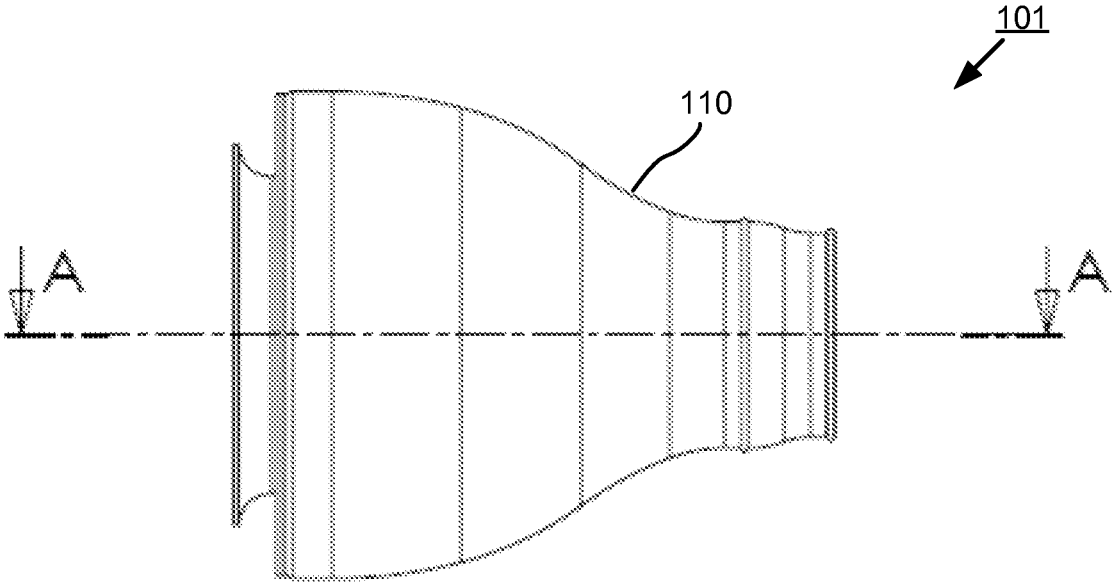
FIGS. 3-3A depict a side view of an assembled exemplary air intake housing assembly and cross-section thereof, according to an exemplary embodiment.
Figure 3A:
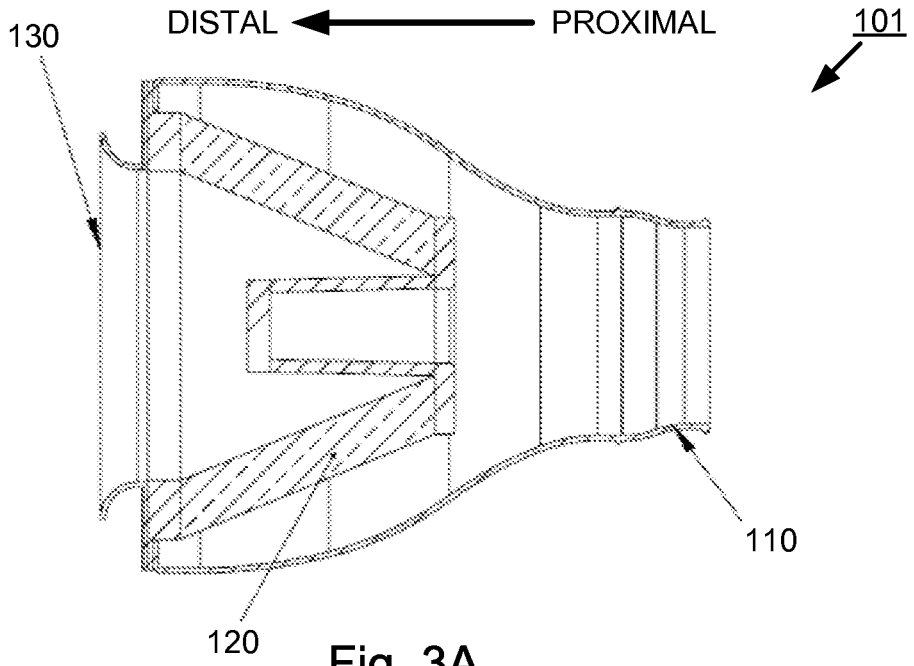
Figure 4:
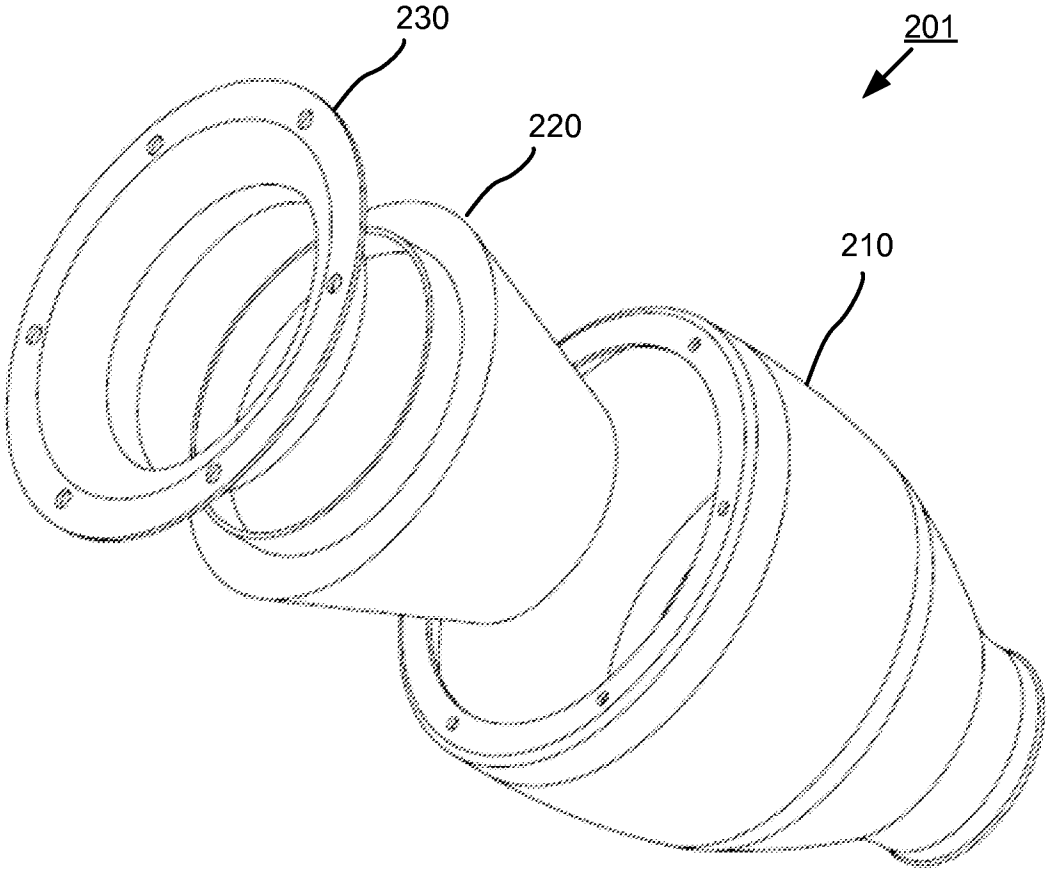
FIG. 4 depicts a perspective view of an exemplary air intake housing assembly according to another exemplary embodiment.
Figure 5:
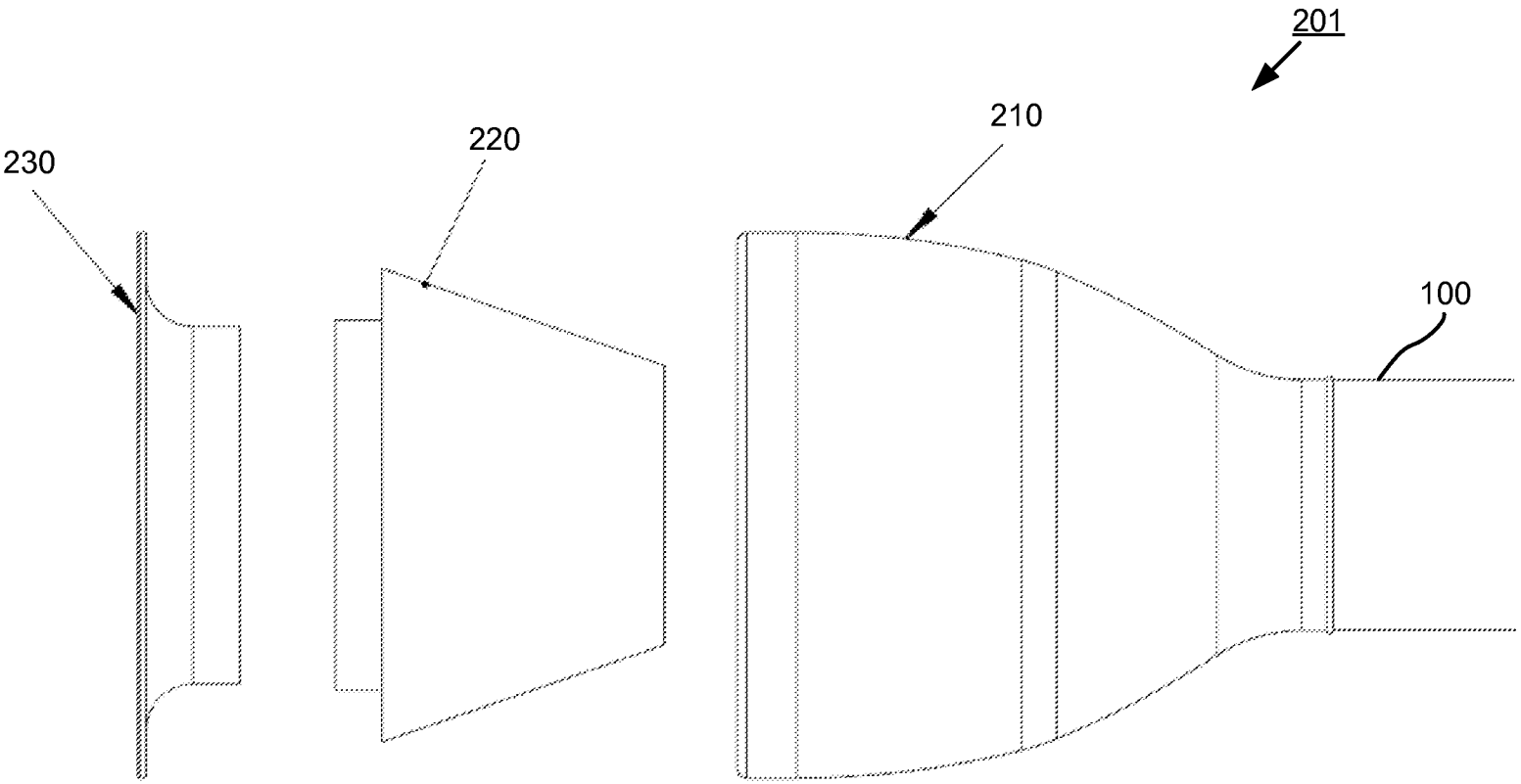
FIG. 5 depicts a side view of the exemplary air intake housing assembly of FIG. 4, according to an exemplary embodiment.

Referring to FIGS. 3-3A, a side view of an assembled exemplary air intake housing assembly 101 and cross-section thereof are shown. As shown, the diameter of the housing 110 decreases gradually from a distal portion to a proximal portion. "Distal" refers to the large diameter side of the housing 110 and is the portion farthest from the engine inlet 100. "Proximal" refers to the small diameter side of the housing 110 and is the portion closest to the engine inlet 100, and in some embodiments may be coupled directly to the engine inlet 100 (FIG. 2). The distal end of the housing 110 may be positioned near a front of the vehicle, such as behind a grille or near a headlamp of the vehicle. More specifically, the distal opening of the housing 110 may be positioned such that air passes through a front of the vehicle and into the housing 110.

As shown in FIGS. 1-6A, the diameter of the housing 110, 210 may decrease over substantially the entire length of the housing 110, 210. This gradual reduction in diameter allows the airflow to be substantially laminar while traveling through the housing. In other words, the motion of the air is orderly with the air particles moving substantially in straight lines parallel to the walls of the housing 110, 210 with little lateral mixing or cross-currents perpendicular to the walls of the housing 110, 210.

Conical filter 120 may be a double cone or single cone conical filter, for example. FIGS. 1-3A show a double cone conical filter 120 where one outer cone encapsulates an inner cone. As shown in FIG. 3A, an outer diameter of the filter 120 may correspond to, or be substantially equal to, an inner diameter of the housing 110 at a distal end of the housing 110 and filter 120. Moving proximally, as the diameter of the filter 120 decreases, so too does the diameter of the housing 110, though not necessarily by the same degree. Conical filter 120 may be attached to housing 110 by various means, including, for example, nuts and bolts or screws. Preferably the filter 120 is not fixedly attached to housing 110 (e.g., by glue) so as to enable removal of filter 120 after a period of time, such as when filter 120 is dirty.

Inlet cowl 130 may optionally be secured to a distal end of housing 110 and filter 120 by various means, including, for example, nuts and bolts or screws. The purpose of the optional inlet cowl 130 is to further guide airflow into filter 120 and housing 110. As shown in FIG. 3A, an inner diameter of the inlet cowl 130 at a proximal end thereof may correspond to, or be substantially equal to, an inner diameter of the filter 120 at a distal end thereof.

As shown in FIGS. 2 and 3A, an outer diameter of the conical filter decreases from a distal to a proximal end thereof. The proximal end of the filter 120 is decoupled from the engine inlet 100 because of housing 110. Filter 120 partially shapes the airflow into a smaller cross-sectional area as air enters the filter 120 at the distal end and traverses toward the proximal end of filter 120. Air that traverses the porous wall of the filter 120 is further shaped by the housing 110 into a smaller cross-sectional area. Thus, at each cross-section of the filter 120 and housing 110, air is being channeled into a smaller cross-sectional area by both the filter 120 and housing 110. This is a substantial departure and improvement over conventional filter and housing combinations where one or both of the filter and housing did not channel airflow therethrough into a smaller cross-sectional area due to their geometrical shape and orientation with respect to the engine inlet.

The smooth reduction in cross-sectional area of the disclosed air filter housing assembly allows the airflow to remain laminar and therefore maximizes the aerodynamic efficiency of the system, which results in increased power output of the engine. The funnel-like shape of the housing 110 in combination with filter 120 invokes the Venturi effect. In accord with the principles of conservation of mass and mechanical energy, a fluid's velocity must increase as it passes through a constriction while its static pressure must decrease. Thus any gain in kinetic energy a fluid may accrue because of its increased velocity through a constriction is balanced by a drop in pressure. As air travels through the housing 110, the air passes through increasingly smaller diametrical cross-sections of the housing 110. Therefore, the airflow velocity increases and there is a drop in pressure at the proximal end of housing 110. This drop in pressure at proximal end of housing 110 effectively sucks additional air through the housing 110 and ultimately into the engine's air inlet 100.

Volumetric flow rate, Q, may be represented by $Q=v_1A_1=v_2A_2$, where v represents velocity and A represents cross-sectional area at points 1 and 2. Pressures ($P_1$ and $P_2$) at points 1 and 2 are represented by $$P_1 - P_2 = \frac{\rho}{2}(v_2^2 - v_1^2).$$

Using these equations, the volumetric flow rate, pressures, and/or air velocities may be calculated at different points, such as at the distal and proximal ends of housing 110/210. Further, cross-sectional areas at the distal and proximal ends of housing 110/210 can be optimized so as to improve flow of ambient air into the engine.

The housing 110 also serves to shield the filter 120 and airflow from engine heat. Thus, the airflow is able to remain as close to ambient air temperature as possible (i.e., ambient with respect to the vehicle). The housing 110 may be made of carbon fiber, i.e., a polymer reinforced with carbon fibers. Alternatively, housing 110 may be made of plastic.

Tests on a dynamometer have shown an increase in power and torque on high performance vehicles that have the air intake housing assembly 101 installed. For example, tests on a BMW E60 M5 shown a gain of approximately 16 horsepower when using the air intake housing assembly 101, compared to a conventional cuboidal air intake housing system. Similarly, on a BMW M3, an increase of 10-15 horsepower was measured when using the air intake housing assembly 101 disclosed herein. Further, on both of these vehicles, there was a significant improvement in throttle response, even at low RPM. The air intake housing assemblies 101, 201 disclosed herein also substantially improve the sound of the engine by naturally amplifying the engine's sound. Conventional cuboidal air filter systems tended to muffle the engine sound.

Figure 6:
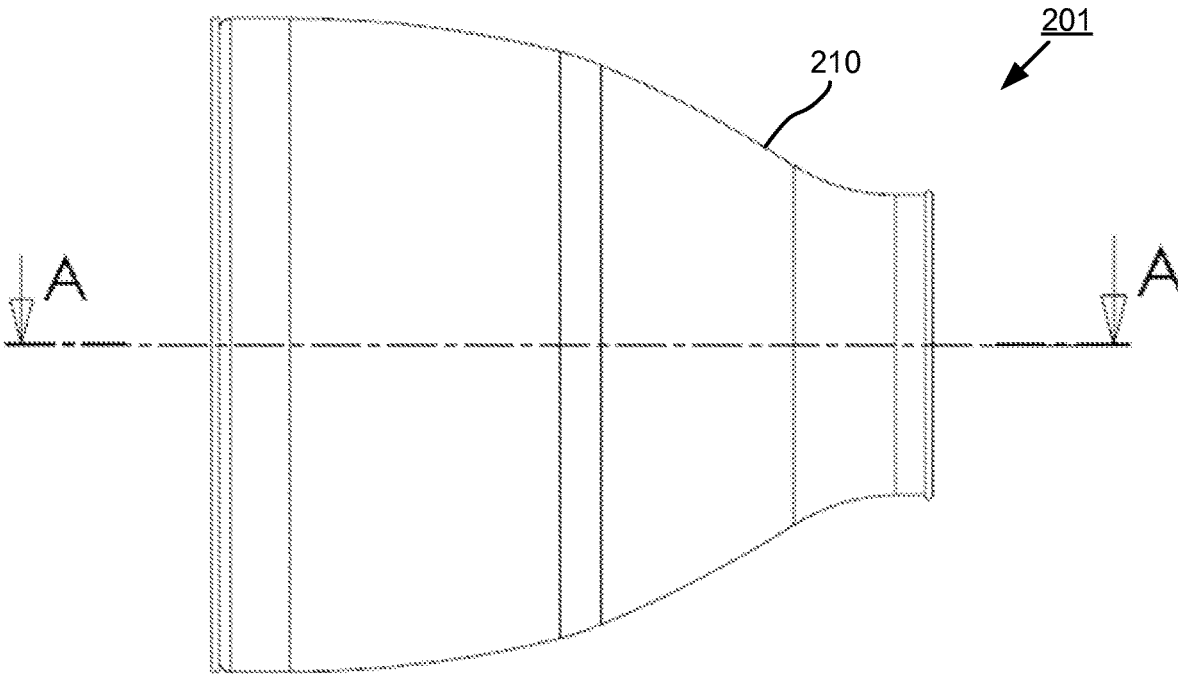
FIGS. 6-6A depict a side view of an assembled exemplary air intake housing assembly and cross-section thereof, according to an exemplary embodiment.
Figure 6A:
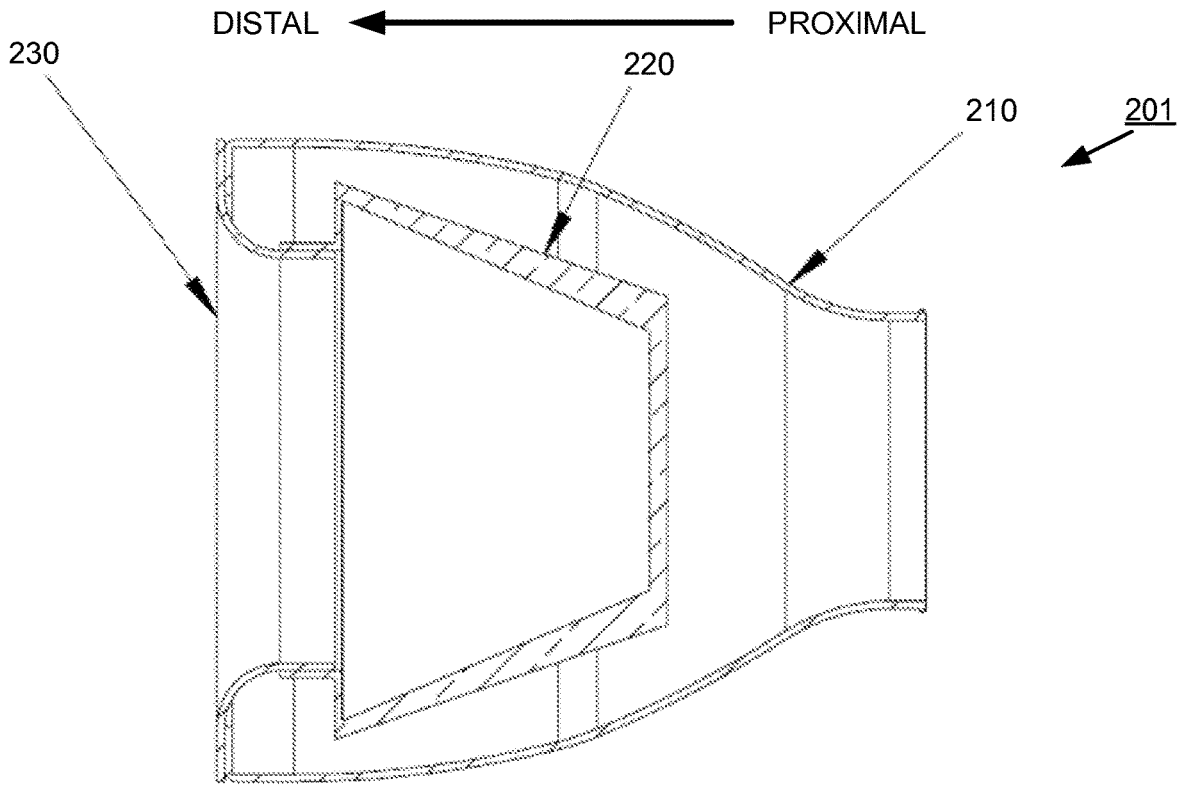

FIGS. 4-6A show an alternative embodiment of an air intake housing assembly 201. Air intake housing assembly 201 may comprise a housing 210, conical filter 220, and optionally an inlet cowl 230. Contrary to assembly 101, assembly 201 may be shorter in length, smaller in diameter, and filter 220 may be a single cone conical filter as opposed to a double cone conical filter. Further, as shown in FIG. 6A, filter 220 may be inset more towards a proximal end of housing 210, and inlet cowl 230 may not protrude from a distal end of housing 210, but may protrude into housing 210 so as to guide airflow directly into filter 220. The cone filter used in this configuration may have a neck on the larger diameter side to which the inlet cowl 230 is secured by clamp or nuts and bolts, for example. In such a case, the inlet cowl 230 protrudes inside the neck of the filter, which allows a clamp to be used on the outside of the neck to secure the filter 220 to the inlet cowl 230. Nevertheless, similar to air intake assembly 101, a cross-sectional diameter of the housing 210 and filter 220 both decrease from a distal end to a proximal end of the assembly 201. And a proximal end of housing 210 is sized so as to correspond to a size of an engine inlet 100. Other similarities between assemblies 101 and 201 may be readily apparent to one of ordinary skill in the art. For example, the distal end of the housing 210 in assembly 201 may be positioned near a front of the vehicle, such as behind a grille or near a headlamp of the vehicle. More specifically, the distal opening of the housing 210 may be positioned such that air passes through a front of the vehicle and into the housing 210.

The dimensions of the air intake assemblies 101 and 201 may vary depending on the vehicle to which the assembly is to be connected and the relative degree of airflow velocity and pressure differential desired with respect to the distal and proximal ends of the housing 110/210. Exemplary outer diameters of housing 110 that provided beneficial results were 198 mm and 83 mm at the distal and proximal ends, respectively, and a length of 223 mm. Exemplary outer diameters of housing 210 include 174 mm and 80 mm at the distal and proximal ends, respectively, and a length of 190 mm.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

While the foregoing illustrates and describes exemplary embodiments of this invention, it is to be understood that the invention is not limited to the construction disclosed herein. The invention can be embodied in other specific forms without departing from the spirit or essential attributes.

What is claimed is:

1. An assembly, comprising:

a housing having a distal end and a proximal end, the proximal end for attaching to an engine air inlet, a diameter of the proximal end having a smaller diameter than a diameter of the distal end;

a filter positioned within the housing and having a proximal end for transmitting filtered air to the engine air inlet and a distal end for receiving unfiltered air, the filter proximal end having a smaller diameter than the filter distal end, and wherein the housing gradually decreases in diameter from the housing distal end to the housing proximal end, such that the cross-sections of the filter and the housing are progressively smaller along the direction of airflow from the distal to proximal ends of the filter.

2. The assembly of claim 1, wherein the distal end of the filter is attached to the distal end of the housing.

3. The assembly of claim 1, further comprising an inlet cowl attached to the distal end of the housing.

4. The air intake assembly of claim 3, wherein a proximal end of the inlet cowl is attached to the distal end of the filter.

5. The assembly of claim 1, wherein the diameter of the proximal end of the housing is sized to attach directly to the engine air inlet.

6. The assembly of claim 1, wherein the filter is a double cone filter.

7. The assembly of claim 1, wherein the filter is a single cone filter.

8. The assembly of claim 1, wherein the housing is composed of carbon fiber material.

9. The assembly of claim 1, wherein the housing is composed of plastic.

10. A method for attaching an air intake assembly to an engine, comprising the steps of:

providing a housing having a distal end and a proximal end, a diameter of the proximal end being smaller than a diameter of the distal end;

providing a filter positioned within the housing and having a proximal end adapted to transmit filtered air and a distal end adapted to receive unfiltered air, the filter proximal end having a smaller diameter than the filter distal end, and attaching the proximal end of the housing to an engine air inlet of an engine, wherein the housing gradually decreases in diameter from the housing distal end to the housing proximal end, such that the cross-sections of the filter and the housing are progressively smaller along the direction of airflow from the distal to proximal ends of the filter.

* * * * *